US007151213B2

(12) United States Patent
Hsieh

(10) Patent No.: US 7,151,213 B2
(45) Date of Patent: Dec. 19, 2006

(54) MUSICAL INSTRUMENT STAND WITH A NECK LOCK ASSEMBLY

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 22 days.

(21) Appl. No.: 11/079,408

(22) Filed: Mar. 14, 2005

(65) Prior Publication Data

US 2006/0201309 A1 Sep. 14, 2006

(51) Int. Cl.
*G10G 7/02* (2006.01)

(52) U.S. Cl. ..... 84/453; 248/443; 84/327; 84/421; 84/329

(58) Field of Classification Search ..... 84/453, 84/327, 421, 329; 24/443
See application file for complete search history.

(56) References Cited

U.S. PATENT DOCUMENTS 6,576,822 B1 * 6/2003 Grace ..... 84/327
6,982,373 B1 * 1/2006 Yu ..... 84/327

* cited by examiner

*Primary Examiner*—Kimberly Lockett

(57) ABSTRACT

A musical instrument stand with a neck lock assembly for a guitar-shaped musical instrument has a post, multiple legs and a neck lock assembly. The neck lock assembly is attached to the post and has a collar, a crossbar assembly and a crossbar fastener. The collar is attached securely to the post and has two distal ends. The crossbar assembly is mounted on one of the distal ends of the collar and has a crossbar pivotally mounted on the distal end of the collar and having a locking recess. The crossbar fastener is mounted on the other distal end of the collar and has two head-halves defining a tapered head. The crossbar pivots toward the crossbar fastener with the tapered head engaging the locking recess to securely lock the neck.

6 Claims, 7 Drawing Sheets

MUSICAL INSTRUMENT STAND WITH A NECK LOCK ASSEMBLY

BACKGROUND OF THE INVENTION

1. Field of the Invention

The present invention relates to a musical instrument stand, and more particularly to a musical instrument stand with a neck lock assembly.

2. Description of Related Art

Conventional musical instrument stands are available to hold musical instruments such as guitars upright for display or maintenance. A guitar-shaped musical instrument has a body, a neck and a head. Therefore, a stand for a guitar-shaped musical instrument generally has a neck lock assembly to hold the neck and the head of the musical instrument.

With reference to FIGS. 6 and 7, a conventional neck lock assembly for a guitar-shaped musical instrument is attached to a stand. The stand has a post having an upper end. The conventional neck lock assembly comprises a collar (70), two pliable pads (80) and a crossbar (90).

The collar (70) is U-shaped, is mounted on the upper end of the post and has two curved sections, two distal ends, a gap and a plug (71). The gap is defined between the distal ends. The plug (71) is mounted on one of the distal ends.

The pads (80) are mounted respectively around the curved sections of the collar (70), and one pads (80) is blocked by the plug (71) so the pad (80) cannot fall off.

The crossbar (90) is mounted pivotally on the distal end of the collar (70) opposite to the plug (71), blocks the pad (80) adjacent to the crossbar (90) and has a proximal end, a distal end and a latch (91). The latch (91) is formed on the distal end of the crossbar (90).

When a guitar-shaped musical instrument having a neck and a body is placed upright on the stand, the neck lock assembly holds the neck in the collar (70). The neck is inserted through the gap of the collar (70). The crossbar (90) pivots down to a closed position, and the latch (91) latches onto the distal end of the collar (70) opposite from the crossbar (90) so the crossbar crosses between the distal ends of the collar (70) and prevents the neck from falling out of the collar (70).

However, the crossbar (90) in the closed position is easily inadvertently released by an unintentional force, and the musical instrument might fall down and be damaged.

To overcome the shortcomings, the present invention provides a musical instrument stand with a neck lock assembly to mitigate or obviate the aforementioned problems.

SUMMARY OF THE INVENTION

The main objective of the invention is to provide a musical instrument stand with a neck lock assembly to securely hold a guitar-shaped musical instrument, which cannot be released unintentionally.

A musical instrument stand with a neck lock assembly in accordance with the present invention comprises a post, multiple legs and a neck lock assembly.

The neck lock assembly is attached to the post and has a collar, a crossbar assembly and a crossbar fastener.

The collar is attached securely to the post and has two distal ends.

The crossbar assembly is mounted on one of the distal ends of the collar and has a crossbar pivotally mounted on the distal end of the collar and having a locking recess.

The crossbar fastener is mounted on the other distal end of the collar and has two head-halves defining a tapered head.

Other objectives, advantages and novel features of the invention will become more apparent from the following detailed description when taken in conjunction with the accompanying drawings.

DETAILED DESCRIPTION OF PREFERRED EMBODIMENT

Figure 1:
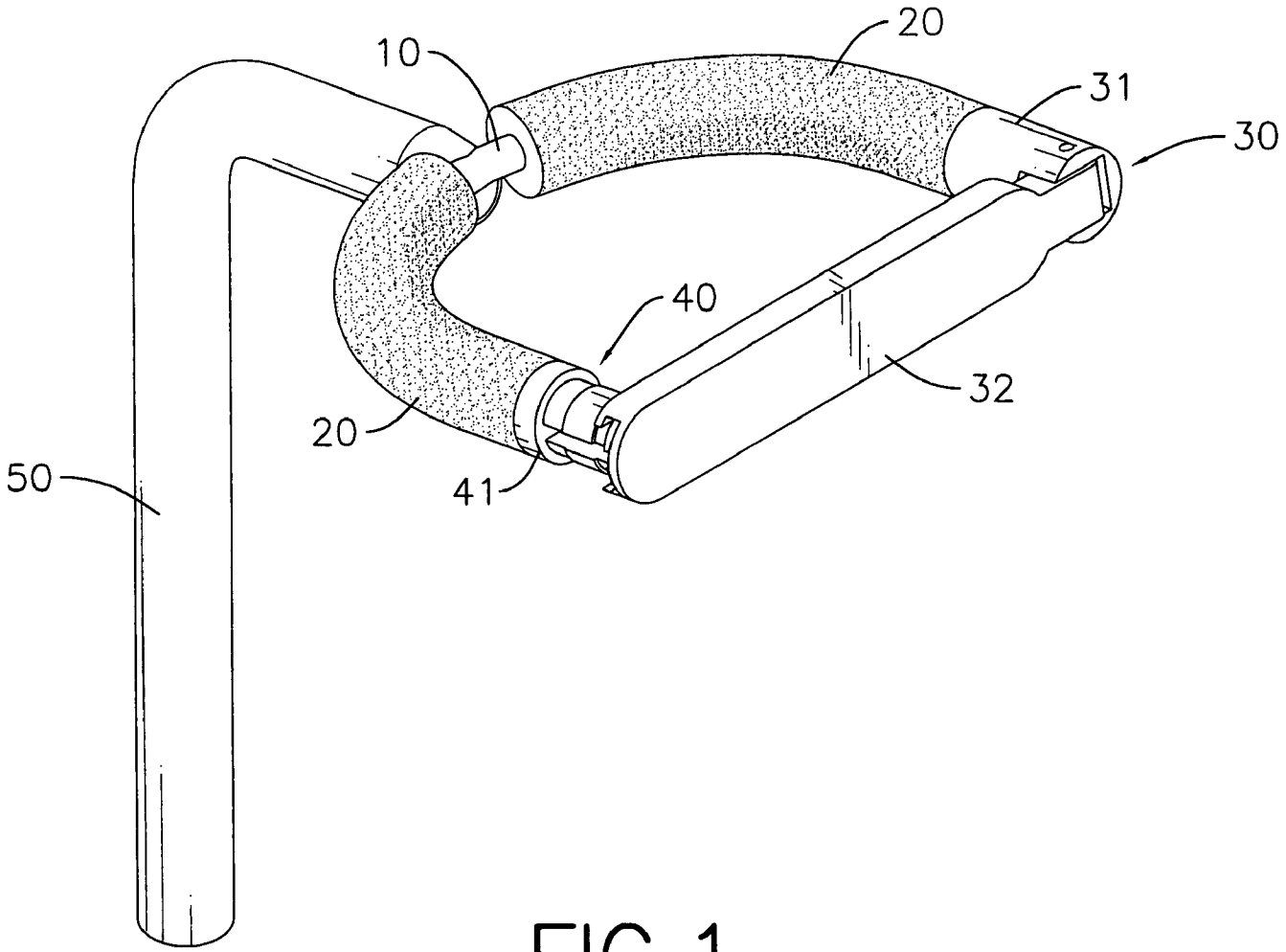
FIG. 1 is a perspective view of a musical instrument stand with a neck lock assembly in accordance with the present invention.
Figure 5:
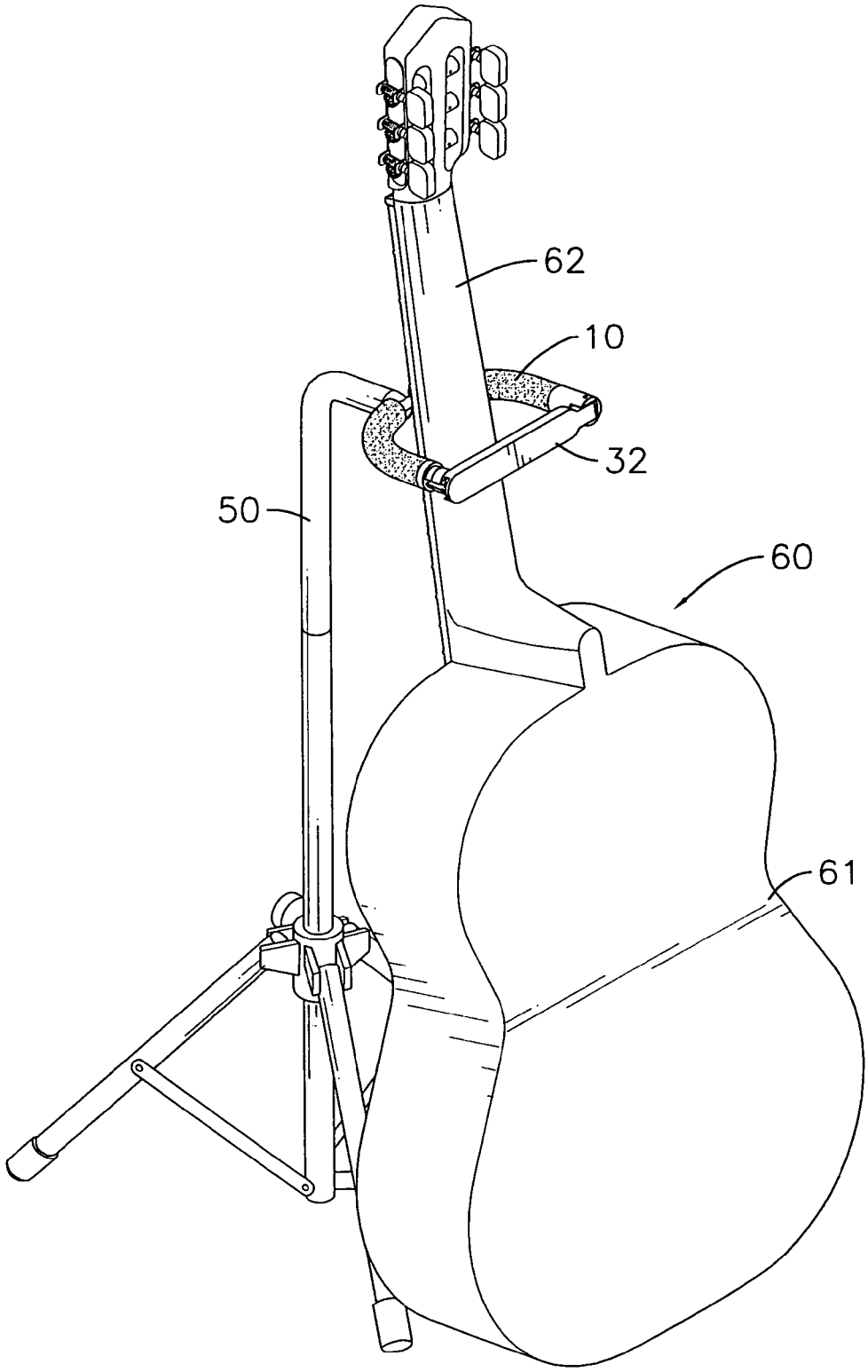
FIG. 5 is an operational perspective view of the musical instrument stand in FIG. 1. with a guitar-shaped musical instrument.
Figure 6:
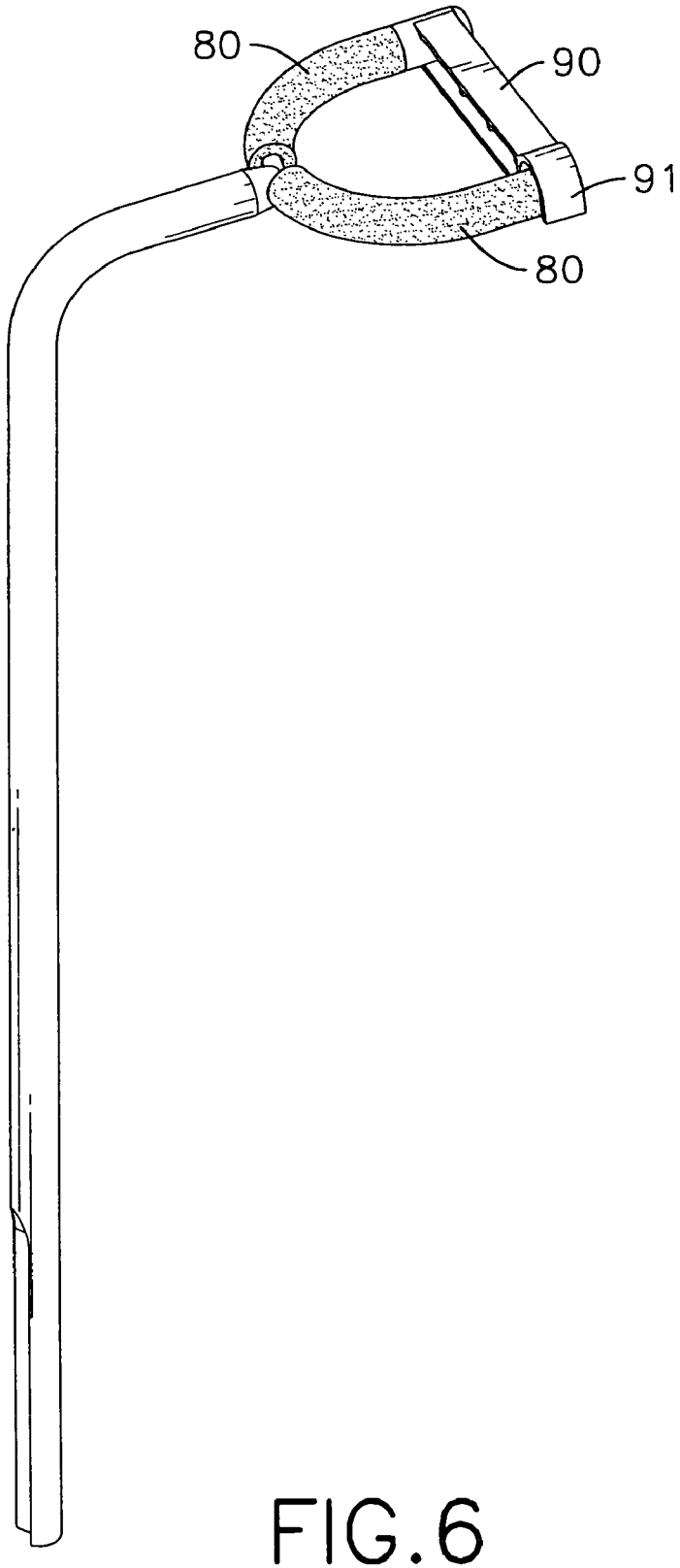
FIG.6 PRIOR ART
FIG. 6 is a perspective view of a musical instrument stand with a conventional neck lock assembly in accordance with the prior art.
Figure 7:
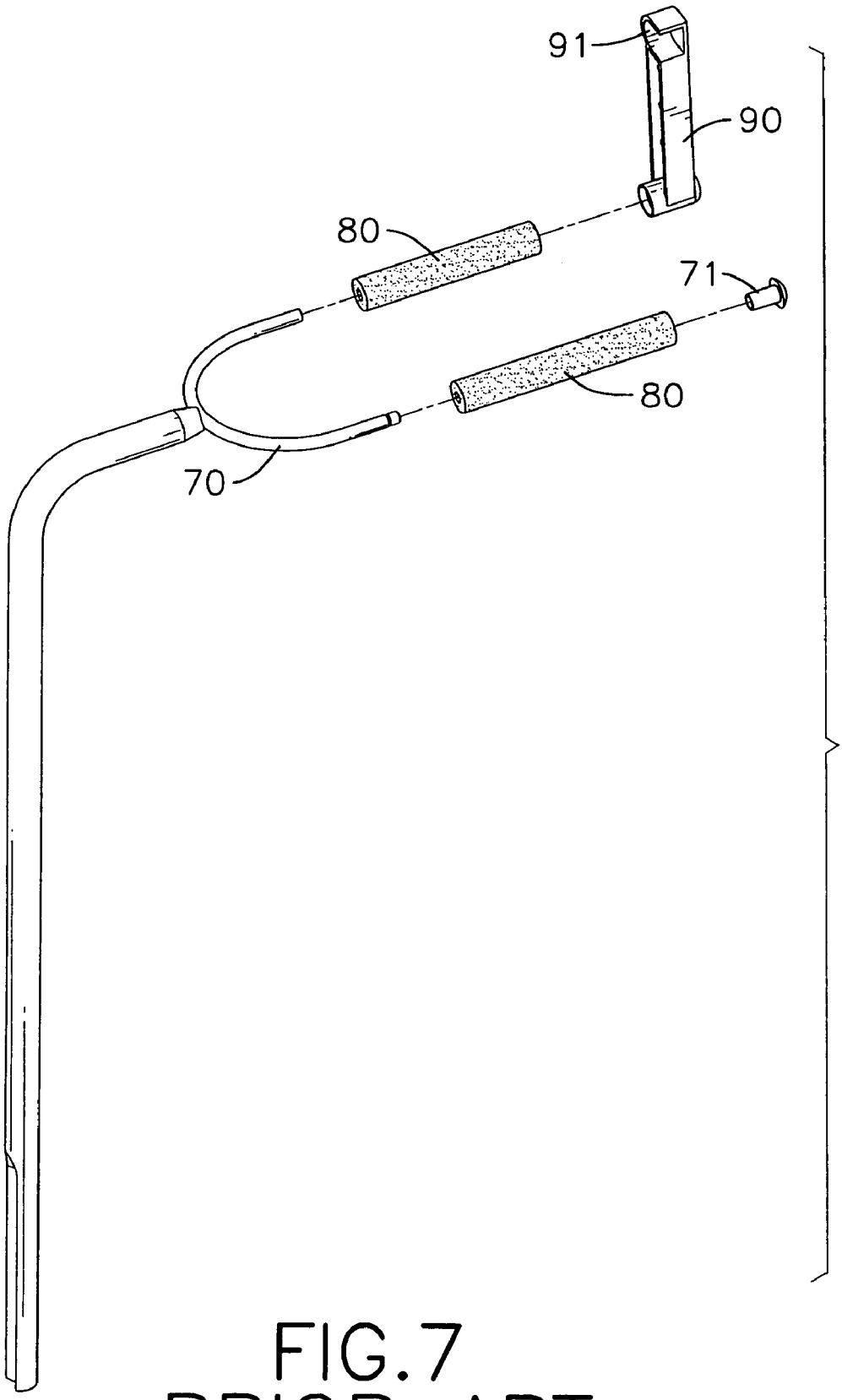
FIG.7 PRIOR ART
FIG. 7 is an exploded perspective view in partial section of the neck lock in FIG. 6.

With reference to FIGS. 1 and 5, a musical instrument stand with a neck lock assembly in accordance with the present invention holds a guitar-shaped musical instrument (60) upright. The guitar-shaped musical instrument (60) has a body (61) and a neck (62). The neck (62) is attached to the body (61).

The musical instrument stand comprises a post (50), multiple legs and a neck lock assembly.

The post (50) has an upper end and a lower end.

The legs are attached to the post (50) close to the lower end and extend radially out from the post (50).

Figure 2:
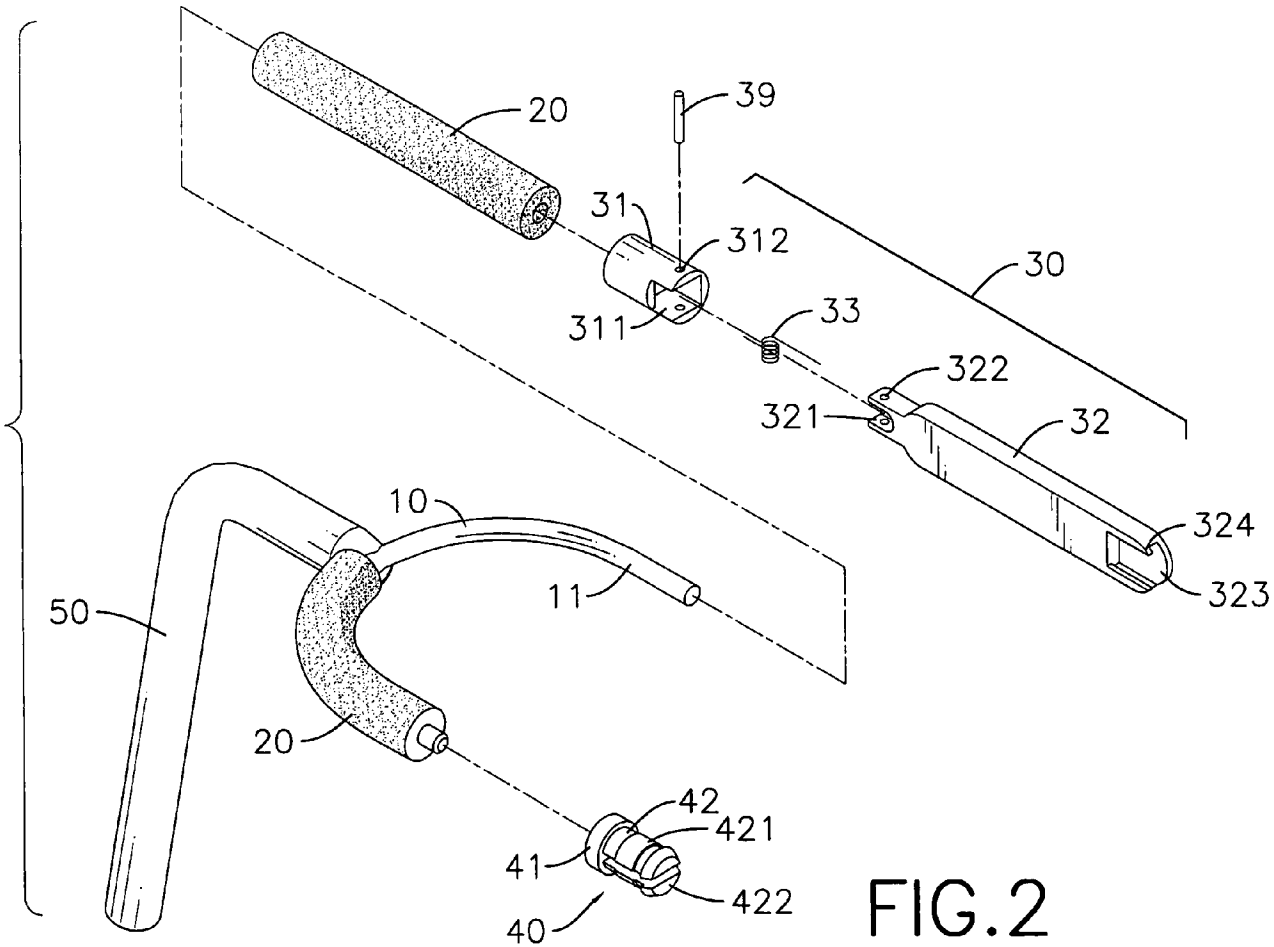
FIG. 2 is an exploded perspective view of the neck assembly in FIG. 1.
Figure 3:
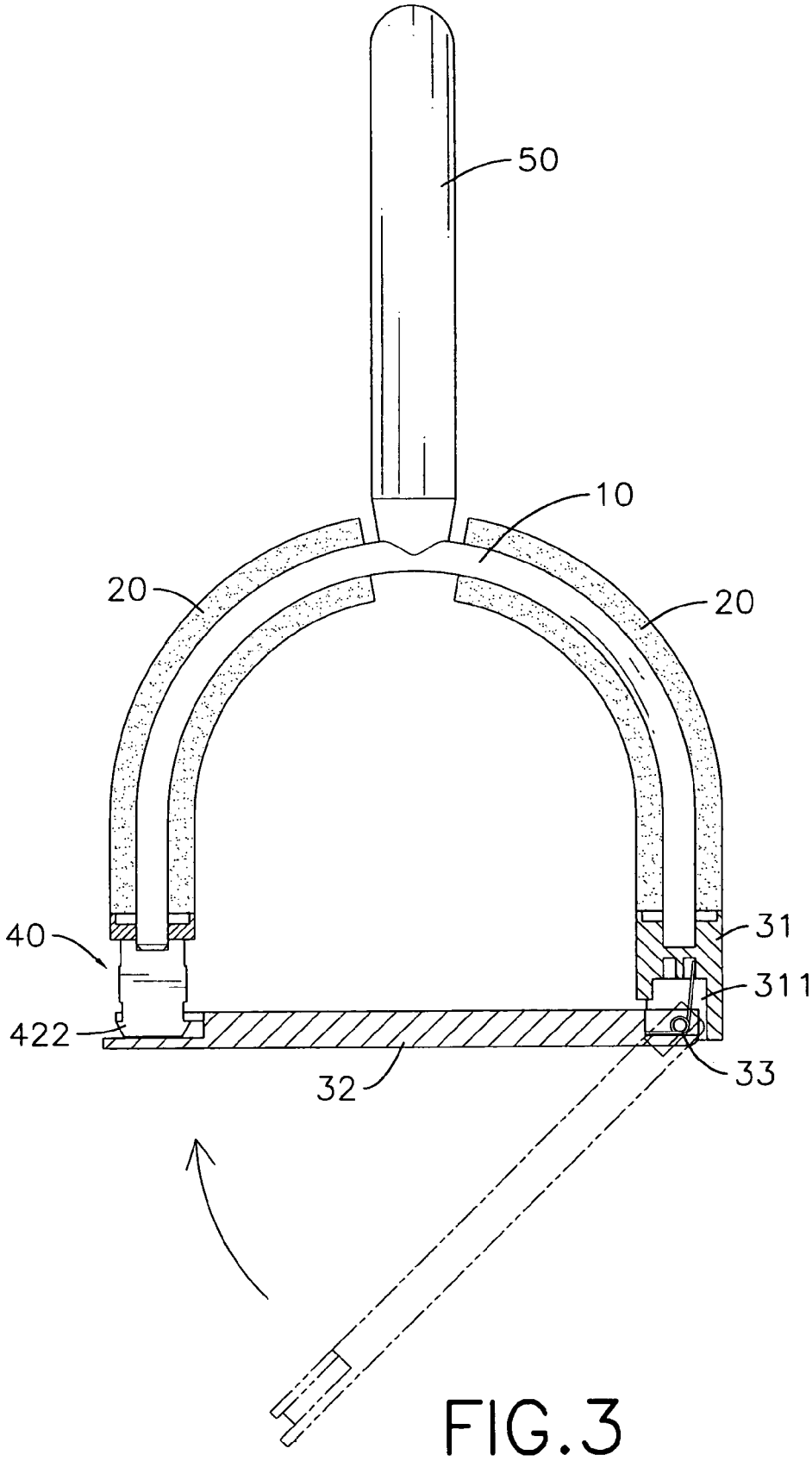
FIG. 3 is an operational top view in partial section of the neck lock assembly in FIG. 2.

With further reference to FIGS. 2 and 3, the neck lock assembly is attached securely to the upper end of the post (50) and has a collar (10), two pads (20), a crossbar assembly (30) and a crossbar fastener (40).

The collar (10) is U-shaped, is attached securely and horizontally to the upper end of the post (50) and has two curved sections (11) and two distal ends.

The pads (20) are made of pliable material such as foam rubber, padded cloth or the like and are mounted respectively around the curved sections (11) to cushion the neck (62) of the guitar-shaped musical instrument (60).

The crossbar assembly (30) is attached to one of the distal ends of the collar (10) and has a crossbar bracket (31), a crossbar (32), a pivot pin (39) and a spring (33).

The crossbar bracket (31) is attached securely to a distal end of the collar (10) and has a proximal end, a distal end, a mounting recess, two side tabs and two pin holes (312). The mounting recess (311) is defined in the distal end of the crossbar bracket (31). The side tabs are formed at the distal end of the crossbar bracket (31) by the mounting recess (311) and are separated and opposite from each other. The pin holes (312) are defined respectively through the side tabs and communicate with the mounting recess (311).

The crossbar (32) is mounted pivotally on the distal end of the crossbar bracket (31) and has a proximal end, a distal end, a spring recess (321), two side tabs, two pinholes (322), a locking recess (323) and two latch lips (324). The proximal end of the crossbar (32) is mounted pivotally in the mounting recess (311) between the side tabs in the crossbar bracket (31). The spring recess (321) is defined in the proximal end of the crossbar (32) and has an inner surface. The side tabs are formed on the proximal end around the spring recess (321) in the crossbar (32) separated from and opposite to each other. The pin holes (322) are defined respectively through the side tabs in the crossbar (32) and communicate with the spring recess (321). The locking recess (323) is defined in the distal end of the crossbar (32) and has two opposite outside edges. The latch lips (324) perpendicularly extend respectively from the outside edges toward each other and are separated from each other by a distance.

The pivot pin (39) extends through the pin holes (312) in the crossbar bracket (31) and the pin holes (322) in the crossbar (32) to attach the crossbar (32) pivotally to the crossbar bracket (31).

The spring (33) is mounted around the pivot pin (39) in the spring recess (321) in the crossbar (32) and presses against the crossbar bracket (31) and the crossbar (32) to hold the crossbar (32) open.

The crossbar fastener (40) is semi-rigid, is mounted on the distal end of the collar (10) opposite to the crossbar assembly (30) and has a base (41) and two rod-halves (42).

The base (41) has a proximal end and a distal end. The proximal end is mounted on the distal end of the collar (10).

The rod-halves (42) extend from the distal end of the base (41), are separated from each other and correspond to the latch lips (324) on the crossbar (32). Each rod-half (42) has an outside surface, a distal end, a protrusion (421), a head-half (422) and a groove.

The protrusion (421) is formed on the outside surface of the rod-half (42).

The head-half (422) is formed at the distal end of the rod-half (42), corresponds to the locking recess (323) and has a proximal end, a distal end and an outside surface. The outside surface is tapered from the proximal end toward the distal end of the head-half (422). The two separated head-halves (422) defined a tapered head having a proximal end, a distal end and a diameter. The diameter at the proximal end of the tapered head is larger than the distance between the latch lips (324) on the crossbar (32), and the diameter at the distal end is smaller than the distance between the latch lips (324). The tapered head easily slides into the locking recess (323) in the crossbar (32) between the latch lips (324) because the latch lips (324) squeeze the rod-halves (42) together until the latch lips (324) latch respectively onto the head-halves (422).

The groove is defined in the rod-half (42) between the protrusion (421) and the head (422) and corresponds to one of the latch lips (324) on the crossbar (32).

Figure 4:
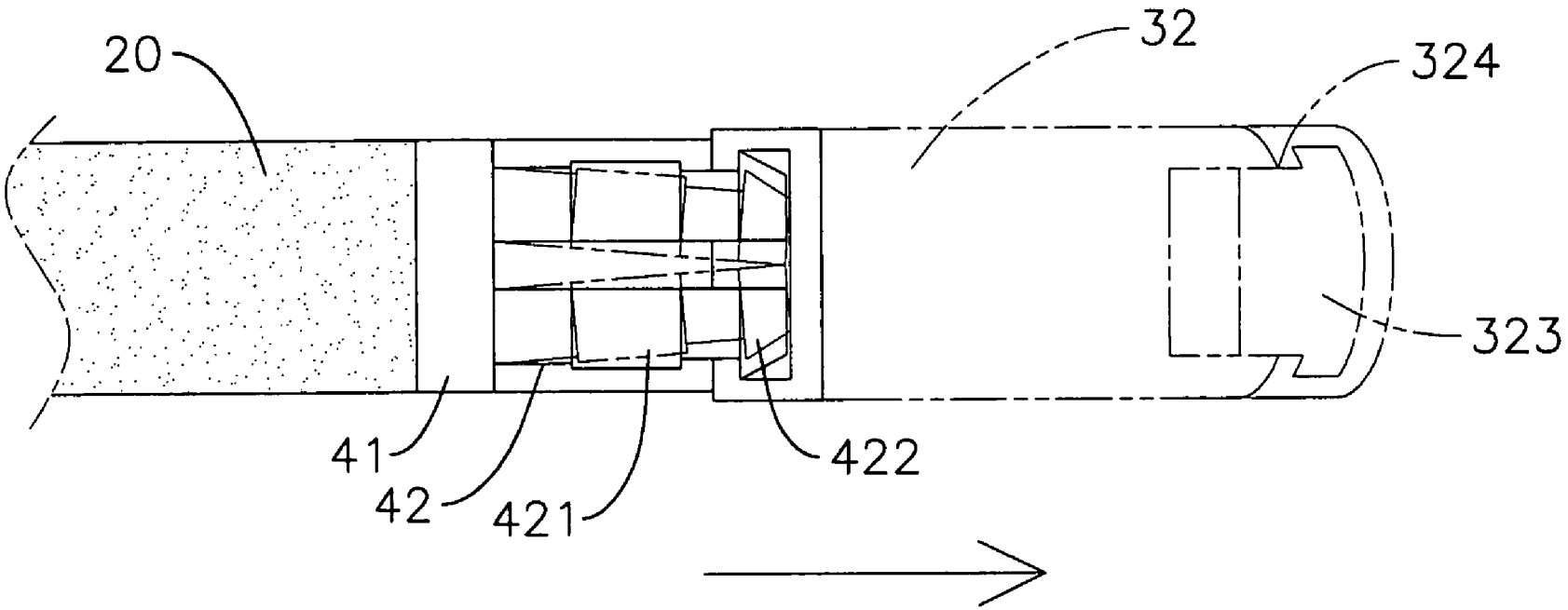
FIG. 4 is an operational side view of the neck lock assembly in FIG. 2.

With further reference to FIG. 4, the musical instrument stand with the neck lock assembly holds the guitar-shaped musical instrument (60) upright by inserting the neck (62) between the curved sections (11) of the collar (10). An external force pivots the crossbar (32) toward the crossbar fastener (40) against the resilient force of the spring (33). The latch lips (324) press against the head-halves (422) and latch respectively onto the head-halves (422) when the tapered head moves into the locking recess (323). The crossbar (32) stops pivoting when locked and the latch lips (324) prevent the crossbar (32) from disengaging from the crossbar fastener (40). The guitar-shaped musical instrument (60) is securely held upright on the stand.

To unlock the crossbar (32), the head-halves (42) on the crossbar fastener (40) are pressed together with a person's fingers until the head-halves (422) release the latch lips (324), and the crossbar (32) is pivoted open.

The neck lock assembly has a simple structure and high safety relative to a conventional neck lock.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A musical instrument stand for a guitar-shaped musical instrument comprising:

a post having an upper end and a lower end;

multiple legs attached to the post close to the lower end and extending radially out from the post; and a neck lock assembly attached securely to the upper end of the post and having a collar being U-shaped, attached securely and horizontally to the upper end of the post and having two curved sections and two distal ends;

a crossbar assembly attached to one of the distal ends of the collar and having a crossbar bracket attached securely to a distal end of the collar and having a proximal end and a distal end; and a crossbar mounted pivotally on the distal end of the crossbar bracket and having a proximal end mounted pivotally on the crossbar bracket;

a distal end;

a locking recess defined in the distal end of the crossbar and having two opposite outside edges; and two latch lips perpendicularly extending respectively from the outside edges toward each other and separated from each other by a distance; and a crossbar fastener being semi-rigid, mounted on the distal end of the collar opposite to the crossbar assembly and having a base having a proximal end mounted on the distal end of the collar; and a distal end; and two rod-halves extending from the distal end of the base, separated from each other and corresponding to the latch lips on the crossbar, and each rod-half having an outside surface;

a distal end;

a protrusion formed on the outside surface of the rod-half;

a head-half formed at the distal end of the rod-half, corresponding to the locking recess and having a proximal end;

a distal end; and an outside surface tapered from the proximal end toward the distal end of the head-half; and a groove defined in the rod-half between the protrusion and the head and corresponding to one of the latch lips on the crossbar.

2. The musical instrument stand as claimed in claim 1, wherein:

the crossbar bracket further has a mounting recess defined in the distal end of the crossbar bracket;

two side tabs formed on the distal end of the crossbar bracket by the mounting recess and separated and opposite from each other; and two pin holes defined respectively through the side tabs and communicating with the mounting recess;

the proximal end of the crossbar is mounted pivotally in the mounting recess between the side tabs of the crossbar bracket, and the crossbar further has two side tabs formed at the proximal end of the crossbar opposite to each other;

two pin holes defined respectively through the side tabs in the crossbar; and a spring recess defined in the proximal end of the crossbar, communicating with the pin holes in the crossbar and having an inner surface; and the crossbar assembly further has a pivot pin extending through the pin holes in the crossbar bracket and the pin holes in the crossbar to attach the crossbar pivotally to the crossbar bracket; and a spring mounted around the pivot pin in the spring recess in the crossbar and pressing against the crossbar bracket and the crossbar to hold the crossbar open.

3. The musical instrument stand as claimed in claim 1 further comprising two pads made of pliable material and mounted respectively around the curved sections.

4. The musical instrument stand as claimed in claim 2 further comprising two pads made of pliable material and mounted respectively around the curved sections.

5. The musical instrument stand as claimed in claim 4, wherein the pliable material is foam rubber.

6. The musical instrument stand as claimed in claim 4, wherein the pliable material is padded cloth.

* * * * *